US007958744B1

(12) United States Patent
Beres et al.

(10) Patent No.: US 7,958,744 B1
(45) Date of Patent: Jun. 14, 2011

(54) REFRIGERANT LINE PURGING APPARATUS

(76) Inventors: Martin Beres, Sugar Land, TX (US); Jesus Cruz Lopez, Katy, TX (US)

( * ) Notice: Subject to any disclaimer, the term of this patent is extended or adjusted under 35 U.S.C. 154(b) by 483 days.

(21) Appl. No.: 12/249,502

(22) Filed: Oct. 10, 2008

Related U.S. Application Data

(60) Provisional application No. 60/979,006, filed on Oct. 10, 2007.

(51) Int. Cl.
*F25B 43/00* (2006.01)

(52) U.S. Cl. ..... 62/474; 62/298

(58) Field of Classification Search ..... 62/474, 62/298, 149, 92, 77
See application file for complete search history.

(56) References Cited

U.S. PATENT DOCUMENTS

| | | | | |
|---|---|---|---|---|
| 3,937,029 | A * | 2/1976 | Grahl et al. | 62/77 |
| 4,184,661 | A * | 1/1980 | Kushner et al. | 251/82 |
| 4,982,576 | A * | 1/1991 | Proctor et al. | 62/292 |
| 5,333,467 | A * | 8/1994 | Pearl et al. | 62/77 |
| 7,097,435 | B2 * | 8/2006 | Erisgen et al. | 417/434 |

* cited by examiner

*Primary Examiner* — Melvin Jones
(74) *Attorney, Agent, or Firm* — Harrison Law Office, P.C.

(57) ABSTRACT

An apparatus for safely and efficiently purging refrigerant lines interconnected with residential and light commercial air conditioning systems. Enhanced safety is achieved by enabling the operator to conduct purge operations away from enclosed areas such as attics and crawlspaces. Efficient use of solvent is achieved by simultaneously connecting a refrigerant line connector to the evaporator end of both suction line and liquid line and discharging solvent and compressed gas through a solvent bridge connected to the compressor end of the liquid line. Thorough contaminant removal enables retrofitting air conditioning systems for use with newer, legally required refrigerants.

19 Claims, 7 Drawing Sheets

80
70

90A
70

100
180

120
160

190

REFRIGERANT LINE PURGING APPARATUS

RELATED APPLICATIONS

This application claims priority based upon Provisional U.S. Application Ser. No. 60/979,006 filed Oct. 10, 2007.

FIELD OF THE INVENTION

The present invention relates to a refrigerant line apparatus, and more particularly relates to an apparatus for purging refrigerant piping or tubing interconnected with residential and light commercial air conditioning systems, preparatory to replacing refrigerant flowing through such refrigerant piping or tubing.

BACKGROUND OF THE INVENTION

As is well known in the art, a conventional air conditioning system includes a pair of refrigerant flow lines comprising a plurality of pipe, commonly called "liquid lines" and "suction lines." Throughout air conditioning systems, suction lines transport evaporated refrigerant and liquid lines transport liquified refrigerant. It is commonplace in the art for practitioners to use copper pipe to implement liquid lines and suction lines for transporting liquid refrigerant such as R-22.

R-22 refrigerant, a hydrochlorofluorocarbon, must be replaced with the more environmentally-friendly R-410A refrigerant by the Jan. 1, 2010 deadline. R-410A consists of a mixture of difluoromethane and pentafluoroethane. Accordingly, as of Jan. 1, 2010 air conditioning equipment designed to accommodate R-22 will no longer be produced.

Nevertheless, thousands—if not millions—of residential and light commercial air conditioning systems installed prior to Jan. 1, 2010 will still operate based upon R-22. Unfortunately, since R-22 is incompatible with R-410A, such preexisting air conditioning systems must be completely purged of any R-22 before the systems are converted to a R-410A basis.

Of course, one approach for converting existing air conditioning systems for use with newer but incompatible refrigerants is to completely replace the existing refrigerant flow lines, typically comprising copper piping. However, as will be appreciated by those skilled in the art, conversion old R-22 refrigerant lines to new R-410A refrigerant lines tends to be cost-prohibitive due to the relatively high price of copper and to the implicated construction costs.

As will be apparent to those skilled in the art, another approach for replacing one refrigerant with another incompatible refrigerant is to flush or purge plurality of copper lines with suitable commercial solvent. Such a flush procedure should be implemented in such a manner to assure removal of all contaminants, thereby rendering the pipelines suitable for use with selected or government-mandated new refrigerants. The present invention teaches an apparatus and associated methodology for safely, efficiently, and expeditiously purging refrigerant lines associated with residential and light commercial air conditioning system, thereby eliminating the necessity to wholly replace the preexisting plurality of copper lines.

SUMMARY OF THE INVENTION

The present invention provides an apparatus and concomitant methodology for safely and efficiently purging existing refrigerant from refrigerant pipe lines and/or tubing lines of residential and light commercial air conditioning systems. As will become evident to those skilled in the art, the preferred embodiment of the present invention may be advantageously invoked preparatory to replacing existing refrigerant with newer, environmentally-acceptable, and government-approved refrigerants.

As will be hereinafter described, the preferred embodiment comprises two primary members: a refrigerant line connector and a solvent bridge. The refrigerant line connector enables quick connection of the liquid line to the suction line. The solvent bridge simultaneously connects each of a cannister of solvent, preferably a commercial solvent, and a tank of pressurized nitrogen gas to one end of the liquid line. After each of the refrigerant line connector and the solvent bridge are joined to a set of refrigerant lines, the remaining free end of the suction line functions as the exclusive only available point of discharge for both solvent and nitrogen gas.

It is a feature and advantage of embodiments of the present invention that both refrigerant suction line and refrigerant liquid line may be purged simultaneously.

It is an object of the present invention to minimize labor and material costs associated with replacing refrigerants in existing air conditioner equipment manifest in residential and light commercial air conditioning systems.

It is another object of the present invention to minimize health risks associated with using hazardous solvents in enclosed spaces such as attics and crawlspaces.

These and other objects of the present invention will become apparent from the following specifications and accompanying drawings, wherein like numerals refer to like components.

BRIEF DESCRIPTION OF THE DRAWINGS

FIG. 7 depicts a photographic image of the refrigerant line connector depicted in

FIG. 2.

FIG. 8 depicts a close-up view of the refrigerant line connector depicted in FIG. 7.

FIG. 9 depicts a photographic image of the solvent bridge depicted in FIG. 3.

FIG. 10 depicts a close-up view of the solvent bridge depicted in FIG. 9.

FIG. 11 depicts a close-up photographic image of a portion of the solvent bridge depicted in FIG. 3.

DETAILED DESCRIPTION

Figure 1:
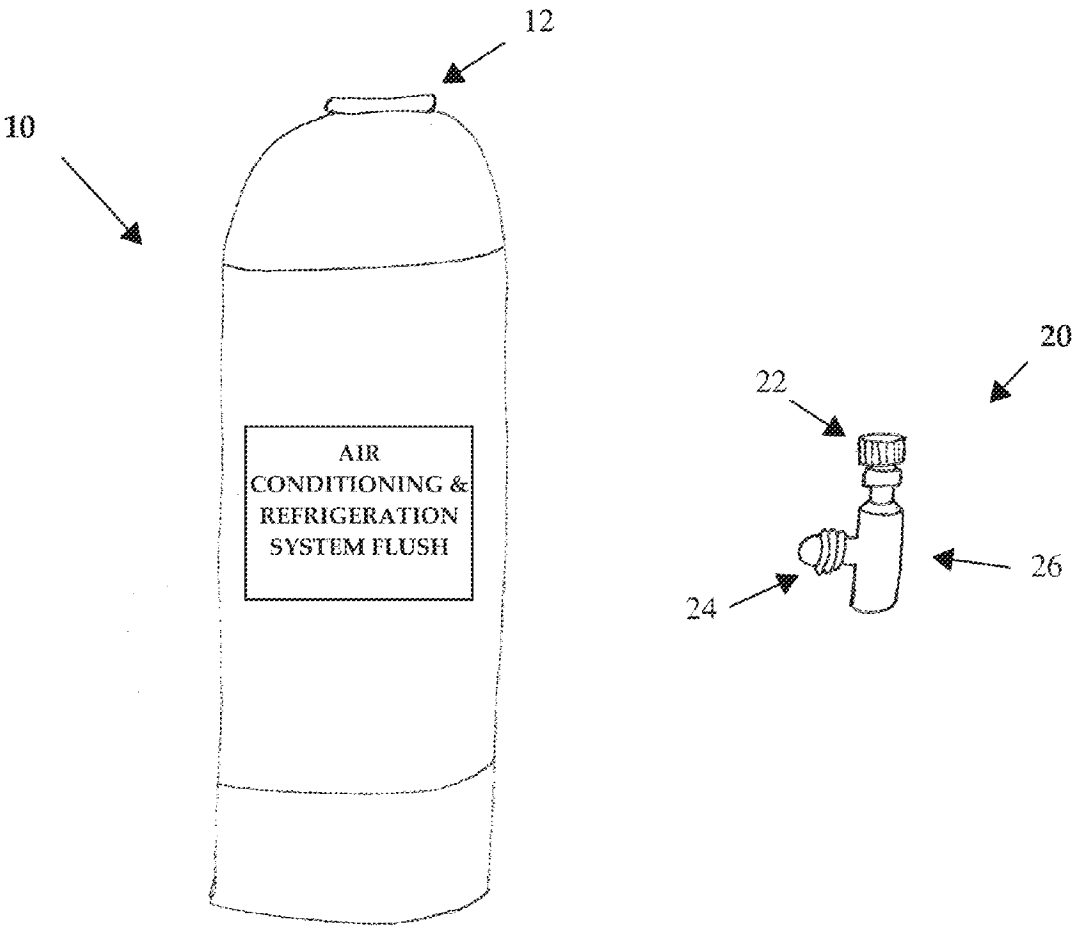
FIG. 1 depicts a front view of a canister containing solvent and accompanying injection tool.

Reference is made herein to the figures in the accompanying drawings in which like numerals refer to like components. Now referring to FIG. 1, there is depicted a commercial air conditioning and refrigeration flushing solvent contained in cannister 10 with accompanying injection tool 20. As should be evident to those skilled in the art, injection tool 20 is invoked to introduce flushing solvent contained within cannister 10 throughout the refrigerant lines of a residential or light commercial air conditioning system. Conventional techniques teach that, preparatory to flushing solvent, each refrigerant line is disconnected from mechanical components; threaded connector 24 of injection tool 20 is inserted into discharge port 12 disposed atop of cannister 10 and releasably mounted to one end of a single refrigerant line; the other end of the refrigerant line remains open to establish an exit-point for contaminants and flushing solvent. Flow valve 22 is rotated to release flushing solvent through casing 26 and then through the releasably mounted refrigerant line. As used herein, cannister refers to a container which is discarded upon depletion of pressurized solvent contained therein, whereas tank refers to a reusable container configured for repeated filling and discharging of pressurized gas.

As is known to those practiced in the art, purging single refrigerant lines often requires discharging of hazardous solvents while operating in enclosed environments such as attics or crawlspaces. Departing from such conventional techniques, embodiments of the present invention purge multiple refrigerant lines simultaneously, thereby allowing rapid and successive introduction of both flushing solvent and nitrogen gas. This simultaneous purging of multiple refrigerant lines enables an operator to safely perform refrigerant line purging even within enclosed spaces notwithstanding restrictive dissipation of toxic chemical fumes and subjecting occupants to dangerously high temperatures. The present invention contemplates use of hydrochlorofluorocarbon resistant materials such as plastic, synthetic rubber, or metal, in the construction of hoses and apparatus elements, thereby minimizing the introduction of additional contaminants into the respective refrigerant lines. Additionally, each member of the present invention is constructed so as to withstand internal pressures comparable to the burst point pressure of typical refrigerant lines. The burst point being defined as the internal pressure at which the structural integrity of a refrigerant line is compromised and liquids or gases are released into the surrounding environment.

Figure 2:
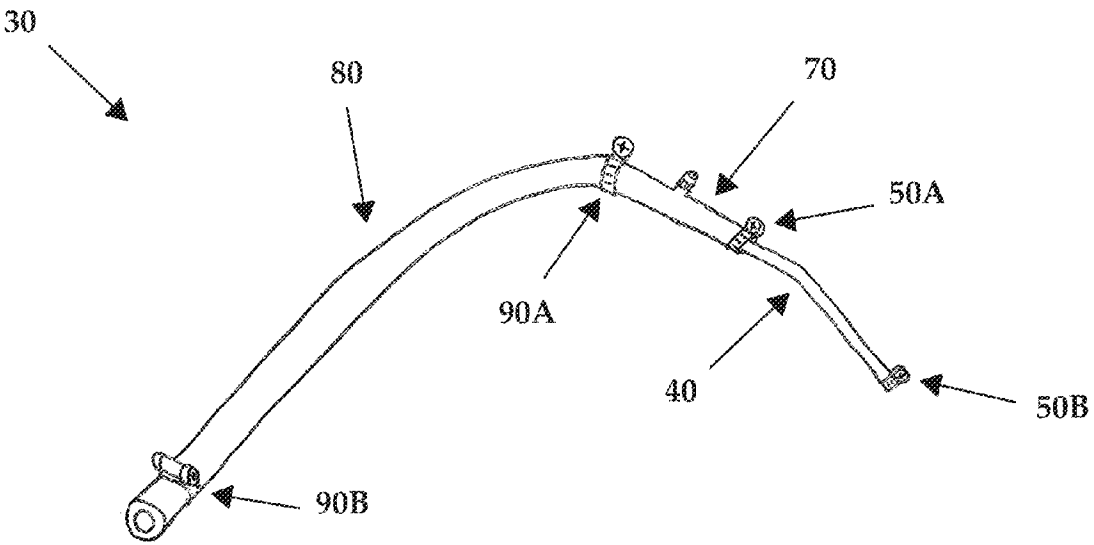
FIG. 2 depicts a frontal perspective view of a refrigerant line connector apparatus of the preferred embodiment of the present invention.
Figures 7, 8, 9, 10, 11:
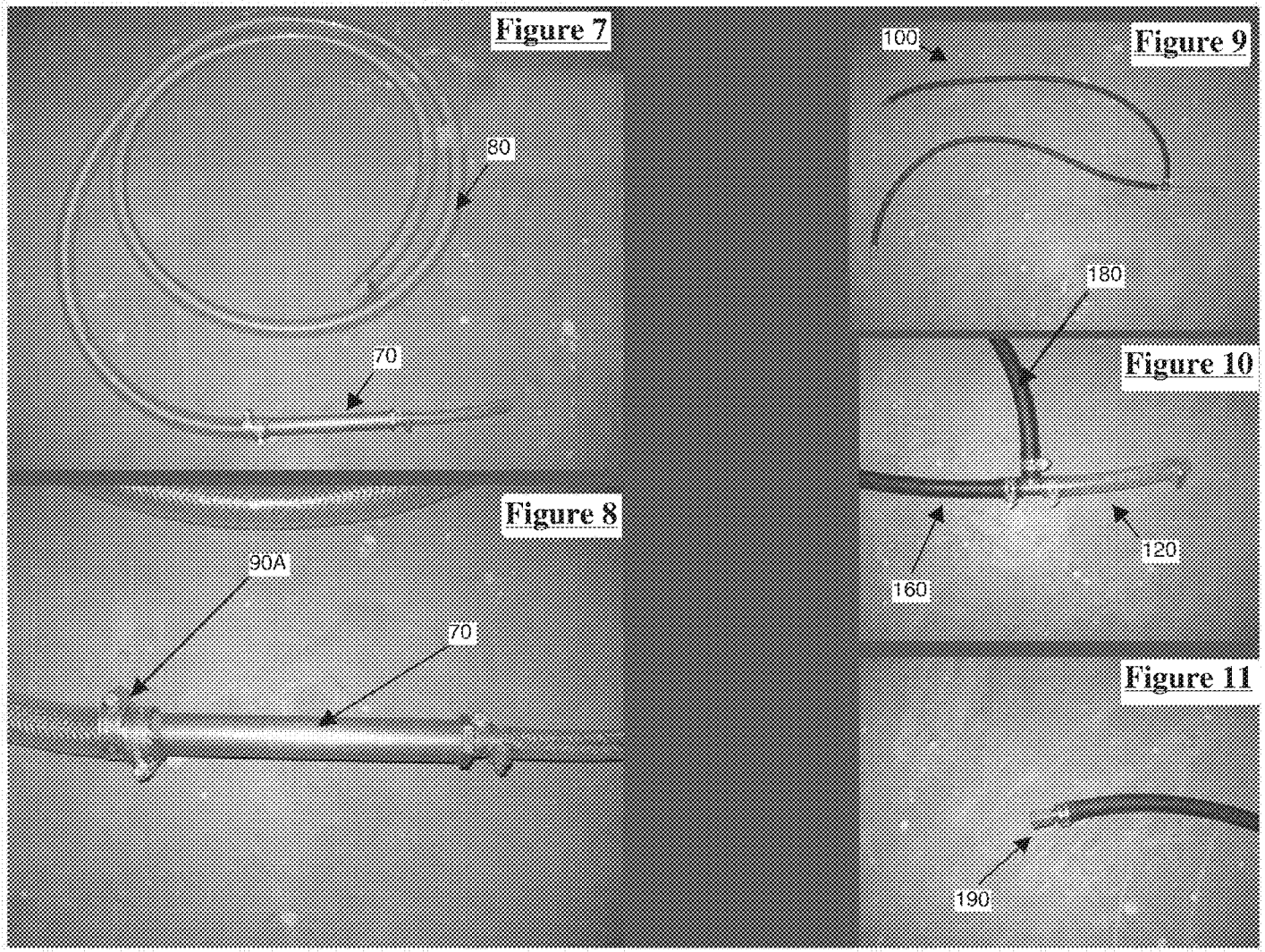

Now referring to FIGS. 2, 7, and 8, there is depicted a frontal perspective view of refrigerant line connector 30 of the preferred embodiment. As is known by those skilled in the art, a conventional air conditioning system comprises both liquid and suction lines. The liquid line transports liquified refrigerant, while the suction line transports evaporated refrigerant. Refrigerant line connector 30 functions as a joinder between the liquid line and suction line of a conventional air conditioning system. Following disconnection of the suction line and/or liquid line from condensers, evaporators or like mechanical components, suction line connection hose 80 is snugly fitted over the end of the refrigeration suction line located within a building or structure, and then releasably mounted upon the refrigerant suction line by tightening ring clamp 90B. Similarly, liquid line connection hose 40 is snugly fitted over the end of the refrigerant liquid line located within a building or structure, and then releasably mounted upon the refrigerant liquid line by tightening ring clamp 50B. The present invention contemplates connection hoses 40 and 80 as being composed of a hydrochlorofluorocarbon resistant material such as plastic or synthetic rubber.

As will be appreciated by those skilled in the art, use of detachable connection hoses or tubing, as contemplated herein, permits connection of embodiments of the present invention with a wide array of variably-sized refrigerant lines.

Still referring to FIGS. 2, 7, and 8, refrigerant line connector 70 completes the joinder between connection hoses 40 and 80, respectively, allowing liquids and gases to flow freely between the liquid line and suction line. Connection hoses 40 and 80 are releasably mounted to refrigerant line connector 70 by adjusting ring clamps 50A and 90A, respectively.

Figure 5:
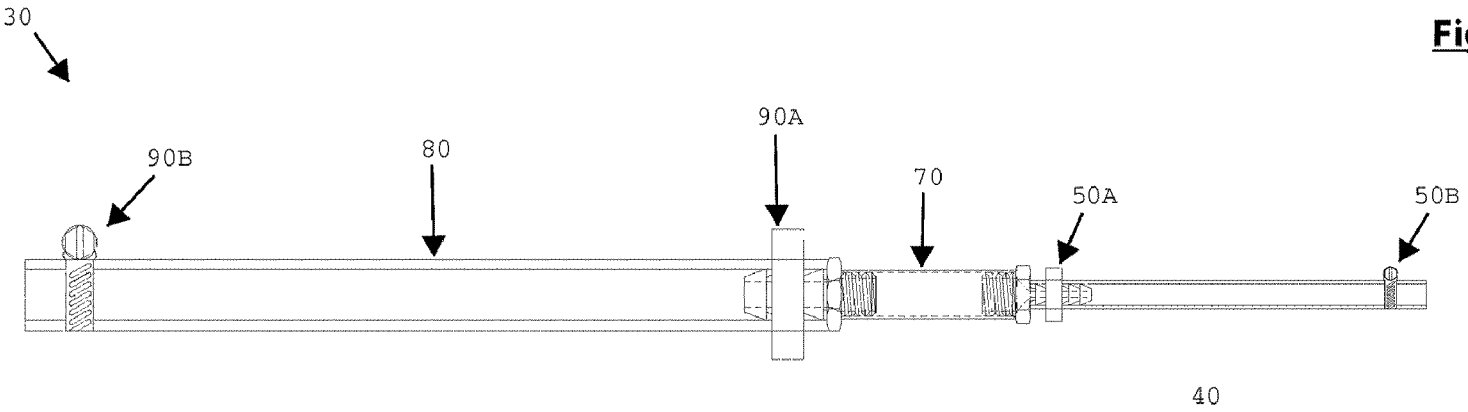
FIG. 5 depicts a front view of an alternate embodiment of the refrigerant line connector apparatus depicted in FIG. 2.

Now referring to FIG. 5, there is depicted an alternate embodiment of the present invention wherein mechanical interconnections between refrigerant line connector 70 and connection hoses 40 and 80, respectively, are achieved with threaded male and female tube adapters 50A and 90A. It will be understood that these corresponding threaded male and female tube adapters 50A and 90A are invoked in lieu of ring clamps. Nevertheless, it should be clearly understood that, in addition to ring clamps and nozzle tube adapters, the present invention contemplates any suitably effective means of achieving mechanical interconnection between refrigerant line connector 70 and connection hoses 40 and 80, respectively.

Figure 3:
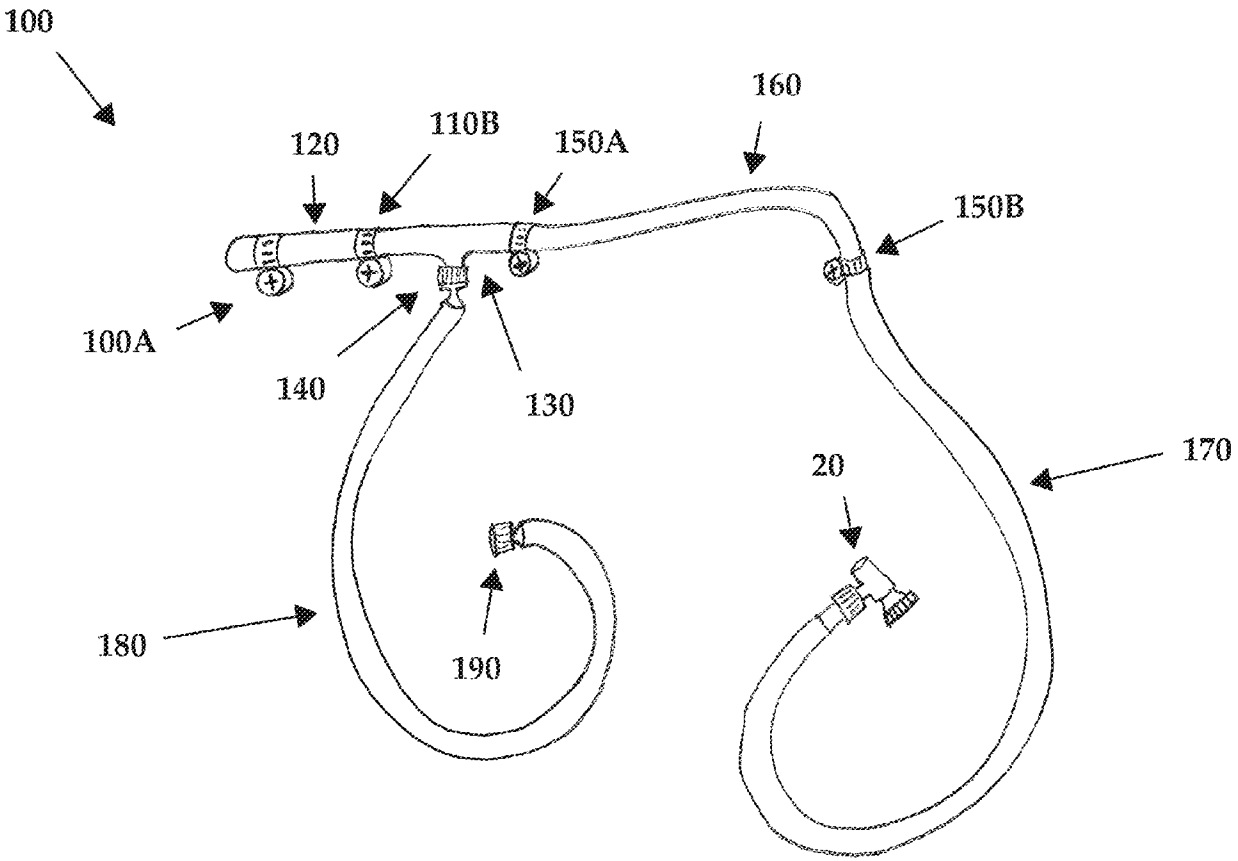
FIG. 3 depicts a frontal perspective view of a solvent bridge of the preferred embodiment of the present invention.

Now referring to FIGS. 3, 9, and 10, there is depicted a frontal perspective view of the preferred embodiment of solvent bridge 100. Liquid line connection hose 120 is fitted over the remaining free end of the refrigerant liquid line and releasably mounted by tightening ring clamp 110A. Liquid line connection hose 120 is fitted to one end of solvent connector 130 and releasably mounted by tightening ring clamp 1108. Similarly, solvent connection hose 160 is fitted over another end of solvent connector 130 and releasably mounted by tightening ring clamp 150A. Solvent hose extension 170 is releasably mounted to solvent connection hose 160 by adjusting ring clamp 150B, in a manner well known in the art. Still referring to FIGS. 3, 9, and 10, there is depicted nitrogen hose connector 140 releasably mounted to solvent connector 130.

Figure 6:
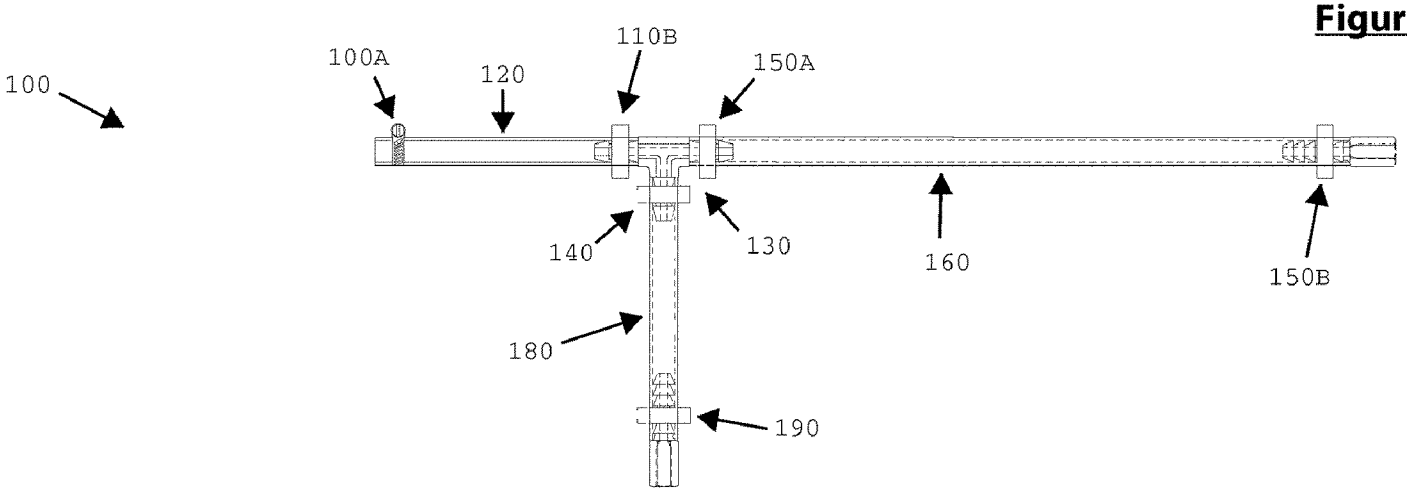
FIG. 6 depicts a front view of an alternate embodiment of the solvent bridge depicted in FIG. 3.
Figure 12:
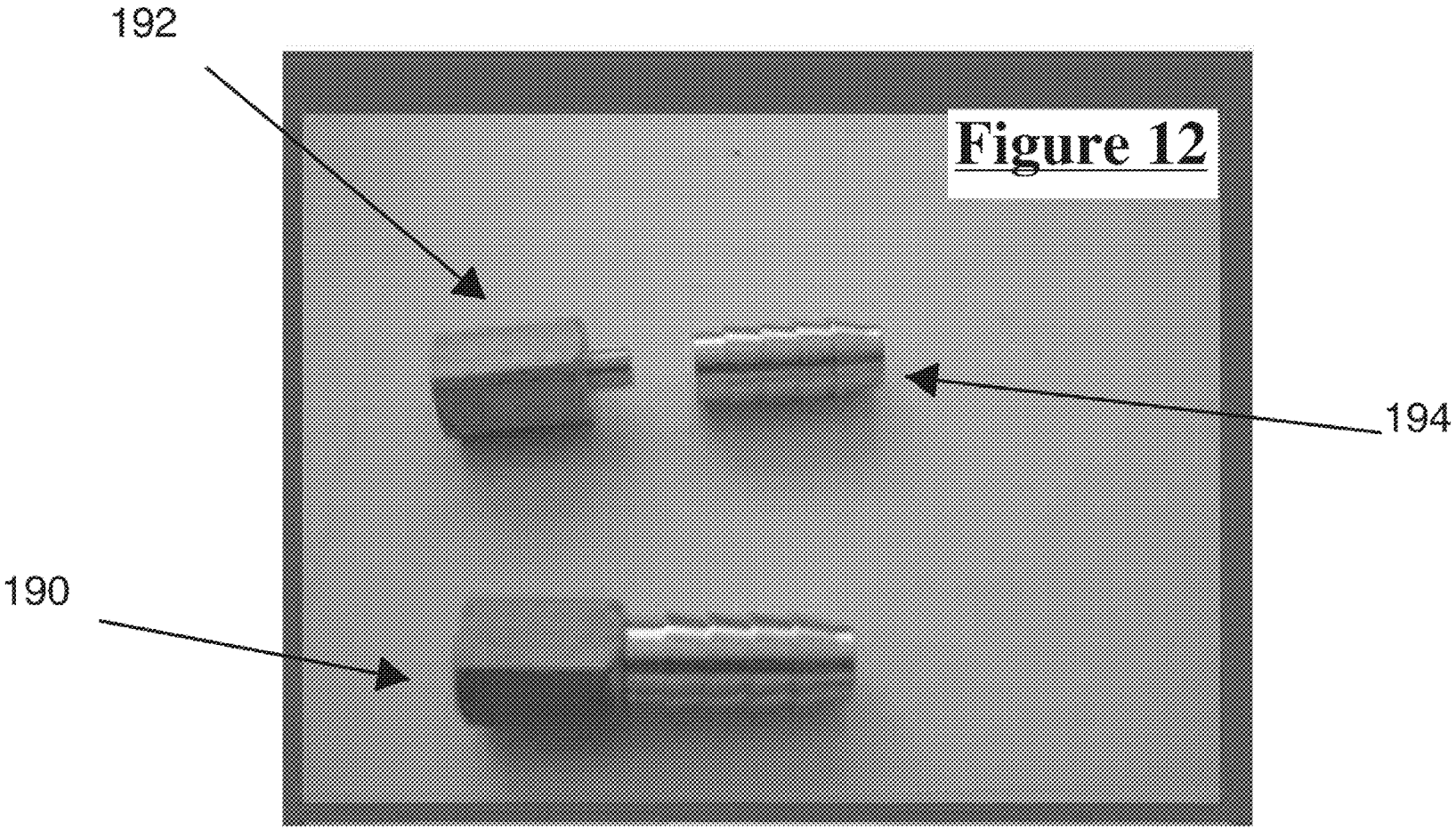
FIG. 12 depicts a photographic image of a portion of the solvent bridge depicted in FIG. 11.

Referring now to FIGS. 6, 11, and 12, there is depicted an alternate embodiment of the present invention, wherein nozzle tube adapters are used to achieve mechanical interconnections between solvent bridge 100 and liquid line connection hose 120, solvent connection hose 160, and nitrogen hose 180, respectively. The remaining ends of solvent connection hose 160 and nitrogen hose 180 are similarly configured with nozzle tube adapter. Specifically, in FIGS. 11 and 12 there is shown a photographic depiction of nitrogen tank connector 190, comprising coupling 192 and nozzle 194, releasably mounted to nitrogen hose 180. In addition to ring clamps and nozzle tube adapters, embodiments of the present invention may be configured with other similarly effective means of achieving a mechanical connection between solvent bridge 100 and solvent connection hose 160 and nitrogen hose 180, respectively.

Figure 4:
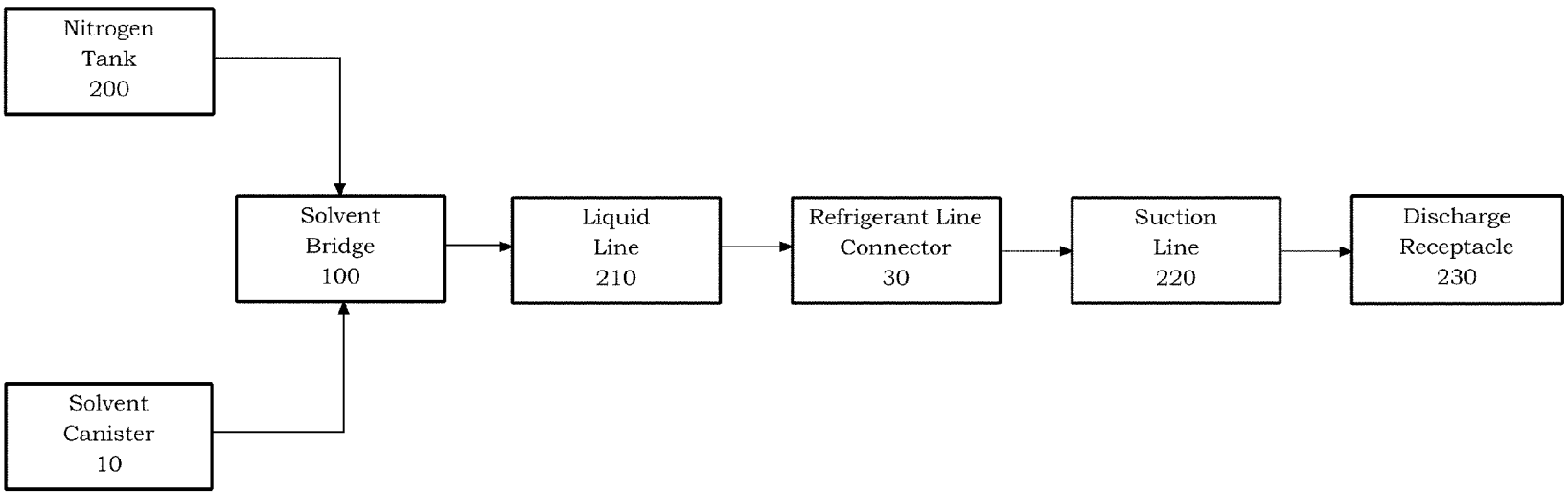
FIG. 4 depicts a flow diagram of the preferred embodiment depicted in FIGS. 2 and 3, illustrating joinder of refrigerant line connector and the solvent bridge embodiments of the present invention with refrigerant lines of a conventional air conditioning system.

Referring now to FIG. 4, there is depicted a flow diagram of the preferred embodiment. It will be seen that the flow of material is from the left-side to the right-side of the diagram. Nitrogen tank 200 and solvent cannister 10 are concurrently attached to solvent bridge 100. Solvent cannister 10 is discharged by opening injector 20, for allowing the solvent to travel through solvent bridge 100, through liquid line 210, through refrigerant line connector 30, and then through suction line 220 where the solvent discharges into discharge receptacle 230. Pressurized nitrogen gas is released from nitrogen tank 200 following an identical path thereby removing residual solvent and contaminants. The purged copper lines are now ready for service with new refrigerants; replacement lines have been rendered unnecessary.

The following is a tabulation of the components depicted in the drawings:

| Components List | |
|---|---|
| # | Component |
| 10 | Solvent |
| 12 | Discharge Port |
| 20 | Injection Tool |
| 22 | Flow Valve |
| 24 | Threaded Connector |
| 26 | Casing |
| 30 | Refrigerant Line Connector |
| 40 | Liquid Line Connection Hose |
| 50A,B | Liquid Line Ring Clamps |
| 70 | Refrigerant Line Connector (Suction/Liquid) |
| 80 | Suction Line Connection Hose |
| 90A,B | Suction Line Ring Clamps |
| 100 | Solvent Bridge |
| 110A,B | Liquid Line Ring Clamps (solvent side) |
| 120 | Liquid Line Connection Hose (solvent side) |
| 130 | Solvent Connector (Solvent/Nitrogen) |
| 140 | Nitrogen Hose Connector |
| 150A,B | Solvent Ring Clamps |
| 160 | Solvent Connection Hose |
| 170 | Solvent Hose Extension |
| 180 | Nitrogen Hose |
| 190 | Nitrogen Tank Connector |
| 192 | Coupling |
| 194 | Nozzle |
| 200 | Nitrogen Tank |
| 210 | Suction Line |
| 220 | Liquid Line |
| 230 | Discharge Receptacle |

Other variations and modifications will, of course, become apparent from a consideration of the structures and techniques hereinbefore described and depicted. Accordingly, it should be clearly understood that the present invention is not intended to be limited by the particular features and structures hereinbefore described and depicted in the accompanying drawings, but that the present invention is to be measured by the scope of the claims appended hereto.

What is claimed is:

1. A refrigerant purge apparatus detachably interconnected with refrigeration piping of an air conditioning system, wherein liquified refrigerant is cyclically transported through a liquid line from a compressor to a remotely located evaporator in which said liquified refrigerant expands to a substantially gaseous state thereupon being transported by pressure differential through a suction line back to said compressor in which now gaseous refrigerant is re-liquified completing a single refrigeration cycle, with said refrigeration piping first being disconnected from said evaporator and said compressor, said refrigerant purge apparatus comprising:

a refrigeration line connector joining an evaporator end of said liquid line proximal to said evaporator to an evaporator end of said suction line proximal to said evaporator, thereby bypassing said evaporator; and a solvent bridge joining each of a compressor end of said liquid line proximal to said compressor, a cannister containing solvent, and a tank containing pressurized gas, thereby enabling simultaneous purging of both said liquid line and said suction line when said solvent and said pressurized gas are released into said liquid line.

2. The refrigerant purge apparatus recited in claim 1, wherein said refrigeration line connector comprises a pair of flexible tube members each having an end frictionally mounted to an opposite end of a rigid tube member.

3. The refrigerant purge apparatus recited in claim 2, wherein a first of said pair of flexible tube members has an inner diameter configured to frictionally receive said evaporator end of said liquid line and a second of said pair of flexible tube members has an inner diameter configured to frictionally receive said evaporator end of said suction line.

4. The refrigerant purge apparatus recited in claim 2, wherein a remaining end of said first of said pair of flexible tube members is detachably mounted to said evaporator end of said liquid line and a likewise remaining end of said second of said pair of flexible tube members is detachably mounted to said evaporator end of said suction line.

5. The refrigerant purge apparatus recited in claim 2, wherein said pair of flexible tube members is composed of a material resistant to degradation when exposed to hydrochlorofluorocarbon refrigerants.

6. The refrigerant purge apparatus recited in claim 2, wherein said rigid tube member is composed substantially of copper.

7. The refrigerant purge apparatus recited in claim 2, wherein said refrigeration line connector comprises a pair of flexible tube members each having an end detachably mounted to an opposite end of a rigid tube member.

8. The refrigerant purge apparatus recited in claim 1, wherein said solvent bridge comprises a rigid tube member having a plurality of ports with each port frictionally mounted to a respective end of each of a plurality of flexible tube members.

9. The refrigerant purge apparatus recited in claim 8, wherein a first of said plurality of flexible tube members has an inner diameter configured to frictionally receive said compressor end of said liquid line.

10. The refrigerant purge apparatus recited in claim 9, wherein an end of said first of said plurality of flexible tube members is detachably mounted to said compressor end of said liquid line and an opposing end of said first of said plurality of flexible tube members is detachably mounted to a first of said plurality of ports.

11. The refrigerant purge apparatus recited in claim 8, wherein an end of a second of said plurality of flexible tube members is detachably mounted to a second of said plurality of ports and an opposing end of said second of said plurality of flexible tube members is detachably mounted to said solvent cannister.

12. The refrigerant purge apparatus recited in claim 8, wherein an end of a third of said plurality of flexible tube members is detachably mounted to a third of said plurality of ports and an opposing end of said third of said plurality of flexible tube members is detachably mounted to said tank containing pressurized gas.

13. The refrigerant purge apparatus recited in claim 8, wherein said pair of flexible tube members is composed of a material resistant to degradation when exposed to hydrochlorofluorocarbon refrigerants.

14. The refrigerant purge apparatus recited in claim 8, wherein said rigid tube member is composed substantially of copper.

15. The refrigerant purge apparatus recited in claim 1, wherein said solvent is contained within a canister having a manually operated discharge nozzle.

16. The refrigerant purge apparatus recited in claim 1, wherein said tank containing pressurized gas has an internal pressure less than the burst point of each of said liquid line and said suction line.

17. The refrigerant purge apparatus recited in claim 1, wherein the gas of said tank containing pressurized gas is composed substantially of nitrogen.

18. The refrigerant purge apparatus recited in claim 1, wherein a discharge port of said cannister and a flow valve of said tank are opened concurrently, thereby releasing said solvent and said pressurized gas into said solvent bridge.

19. The refrigerant purge apparatus recited in claim 18, wherein said cannister containing said solvent is substantially discharged while said tank containing pressurized gas is still discharging, thereby evacuating said solvent from each of said liquid and said suction lines.

* * * * *